US006948945B2

(12) United States Patent
Chen et al.

(10) Patent No.: US 6,948,945 B2
(45) Date of Patent: Sep. 27, 2005

(54) MATRIX CONNECTOR

(75) Inventors: Li-Sen Chen, Taoyuan Hsien (TW); Chien-Yu Hsu, Taoyuan Hsien (TW); Yen-Jang Liao, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/798,428

(22) Filed: Mar. 12, 2004

(65) Prior Publication Data

US 2005/0037641 A1 Feb. 17, 2005

(30) Foreign Application Priority Data

Aug. 11, 2003 (TW) ..... 092122012 A
Jan. 9, 2004 (TW) ..... 093100620 A

(51) Int. Cl.[7] ..... H01R 12/00
(52) U.S. Cl. ..... 439/71; 439/141
(58) Field of Search ..... 439/71, 70, 73, 439/140, 141, 700, 331

(56) References Cited

U.S. PATENT DOCUMENTS 6,036,503 A * 3/2000 Tsuchida ..... 439/70
6,220,870 B1 * 4/2001 Barabi et al. ..... 439/71
6,685,492 B2 * 2/2004 Winter et al. ..... 439/700
6,821,131 B2 * 11/2004 Suzuki et al. ..... 439/73

* cited by examiner

*Primary Examiner*—Gary Paumen
*Assistant Examiner*—Felix O. Figueroa
(74) *Attorney, Agent, or Firm*—Bacon & Thomas PLLC

(57) ABSTRACT

A matrix connector includes a first electrically insulative housing and a second electrically insulative housing arranged in a stack with the respective terminal slots respectively aligned, and terminals sets each formed of a movable terminal axially slidably mounted in the terminal slots of the first electrically insulative housing and a terminal holder mounted in the terminal slots of the second electrically insulative housing and clamped on the respective movable terminal for enabling the respective movable terminal to be moved axially relative to the respective terminal holder when maintained in contact with the respective terminal holder.

14 Claims, 10 Drawing Sheets

MATRIX CONNECTOR

BACKGROUND OF THE INVENTION

1. Field of the Invention

The present invention relates to a matrix connector adapted for testing integrated circuits or circuit boards having high terminal density and more particularly, to such a matrix connector, which produces low contact stress, prevents deformation of solder balls, and allows a big tolerance of flatness of contact surface.

2. Description of the Related Art

The terminals of conventional integrated circuits are commonly made of metal. Therefore, the terminals of conventional integrated circuits have good mechanical strength, and test connectors can be electrically connected to the terminals of integrated circuits by clamping. An integrated circuit having metal terminals can be electrically connected to the internal circuit of an electronic device by SMT or DIP.

In recent years, conventional integrated circuits are made having a high terminal density. Due to high terminal density, it is difficult to connect an integrated circuit with metal terminals to a circuit board by SMT or DIP in mass production. In order to overcome this problem, solder balls are used in integrated circuits to substitute for metal terminals. However, the use of solder balls to substitute for metal terminals complicates test of integrated circuits after packaging.

Because the surface of a solder ball has low mechanical strength and is soft, the terminals of a connector clamp on the solder balls of an integrated circuit may deform the solder balls or force the solder balls away from the integrated circuit.

A good matrix connector has at least the following two features:

1. It does not damage the terminals of the electronic device, allowing reuse of the electronic device.

2. Its terminals can be electrically positively connected to all terminals of the electronic device. An electronic device may have tens or hundreds of terminals. The connector must be electrically connected to all terminals of the electronic device, completing the circuit connection.

There is know a conventional test connector for integrated circuits, which has the terminals set for contacting solder balls from the bottom side. However, this design is not reliable because the terminal design may cause a shot circuit easily.

Therefore, it is desirable to provide a matrix connector that eliminates the drawbacks of the conventional designs.

SUMMARY OF THE INVENTION

The present invention has been accomplished under the circumstances in view. It is the main object of the present invention to provide a matrix connector, which can be used for IC test as well as used as a LGA (Land Grid Array) connector. It is another object of the present invention to provide a matrix connector, which produces low contact stress between the terminal sets and the IC or circuit board during test, preventing deformation of solder balls of the IC. It is another object of the present invention to provide a matrix connector, which prevents an error of contact upon connection of the terminal sets to an IC or printed circuit board having an uneven surface.

To achieve these and other objects of the present invention, the matrix connector comprises a first electrically insulative housing, the first electrically insulative housing comprising a plurality of terminal slots; a second electrically insulative housing connected to the first electrically insulative housing in a stack, the second electrically insulative housing comprising a plurality of terminal slots respectively axially set in communication with the terminal slots of the first electrically insulative housing; and a plurality of terminal sets mounted in the terminal slots of the first electrically insulative housing and the second electrically insulative housing, the terminal sets each comprising a terminal holder mounted in one terminal slot of the second electrically insulative housing and a movable terminal mounted in one terminal slot of the first electrically insulative housing, the movable terminal having a front contact portion suspended in a front end of the respective terminal slot of the first electrically insulative housing remote from the second electrically insulative housing and adapted for connecting to a respective solder ball of an integrated circuit, the terminal holder comprising at least one front clamping arm, which is clamped on the movable terminal in such a manner that the movable terminal is maintained electrically connected to the terminal holder and axially slidable relative to the terminal holder, and rear extension portion extended out of the respective terminal slot of the second electrically insulative housing and adapted for connecting to a circuit board.

DETAILED DESCRIPTION OF THE PREFERRED EMBODIMENT

Figure 1:
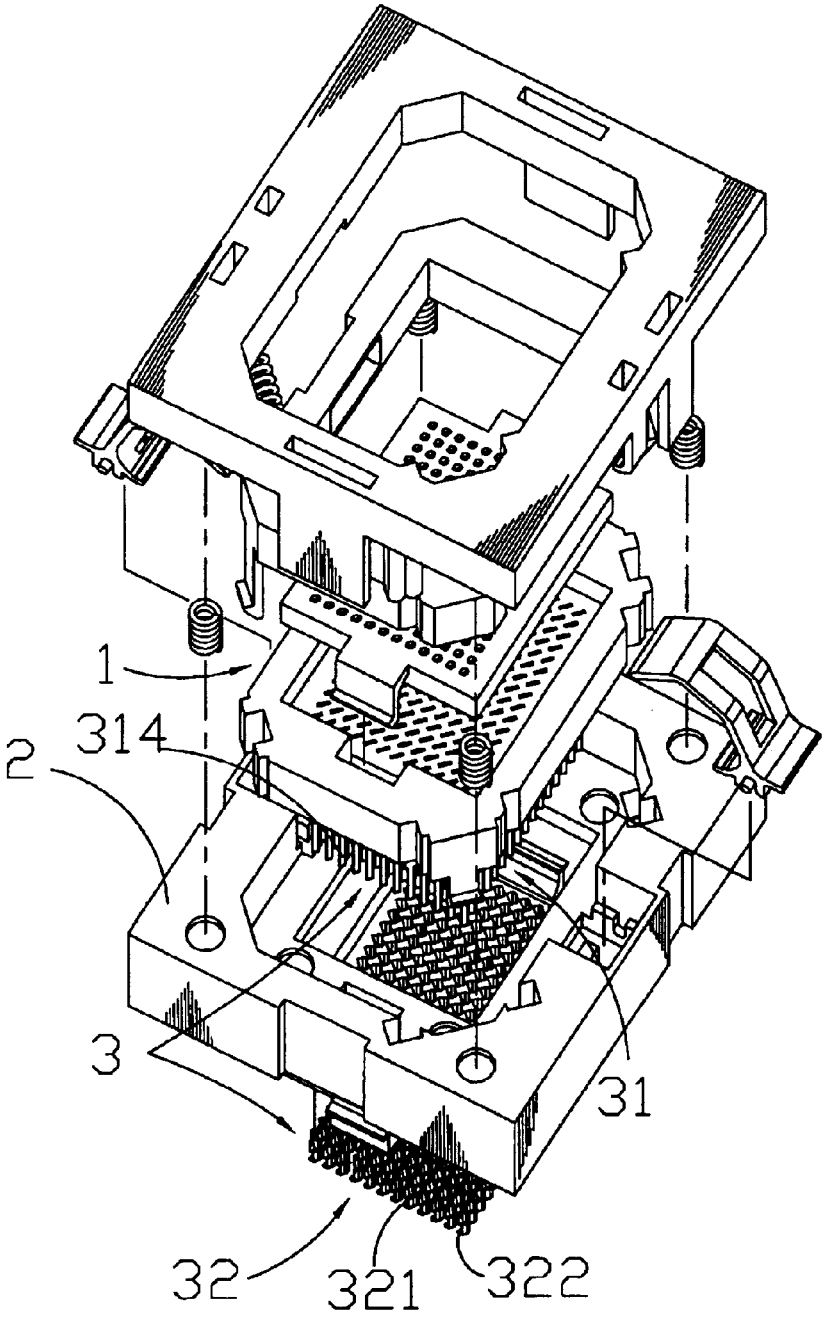
FIG. 1 is an exploded view of a matrix connector according to the first embodiment of the present invention.
Figure 2:
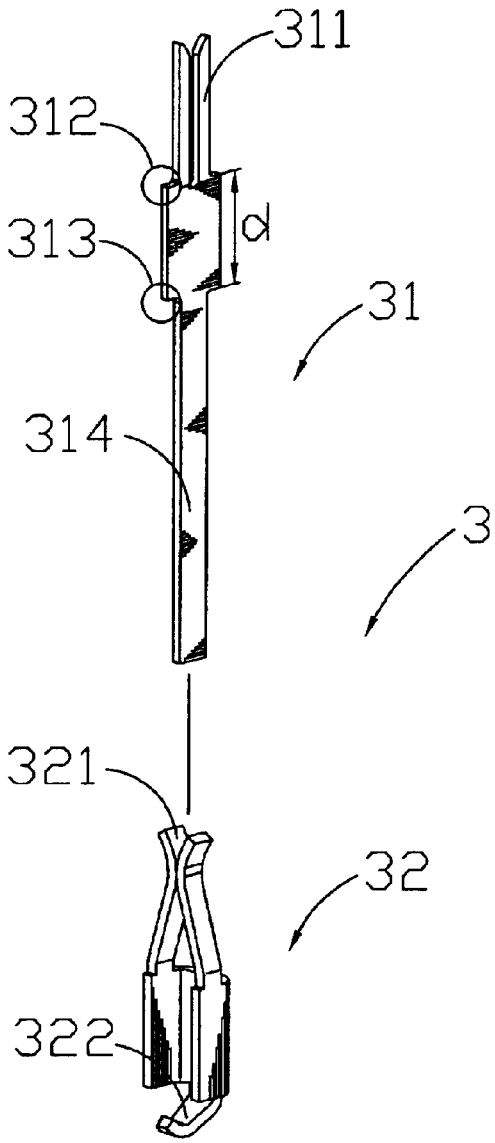
FIG. 2 is an exploded view of one terminal set for the matrix connector according to the first embodiment of the present invention.
Figure 3:
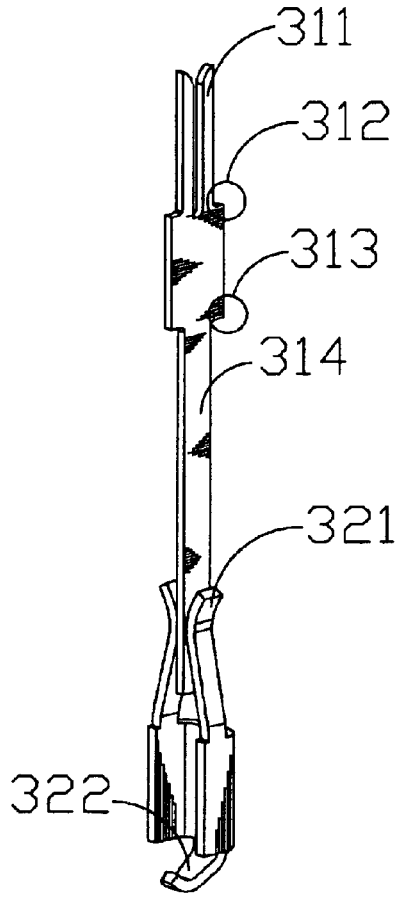
FIG. 3 is an assembly view of the terminal set shown in FIG. 2.
Figure 4:
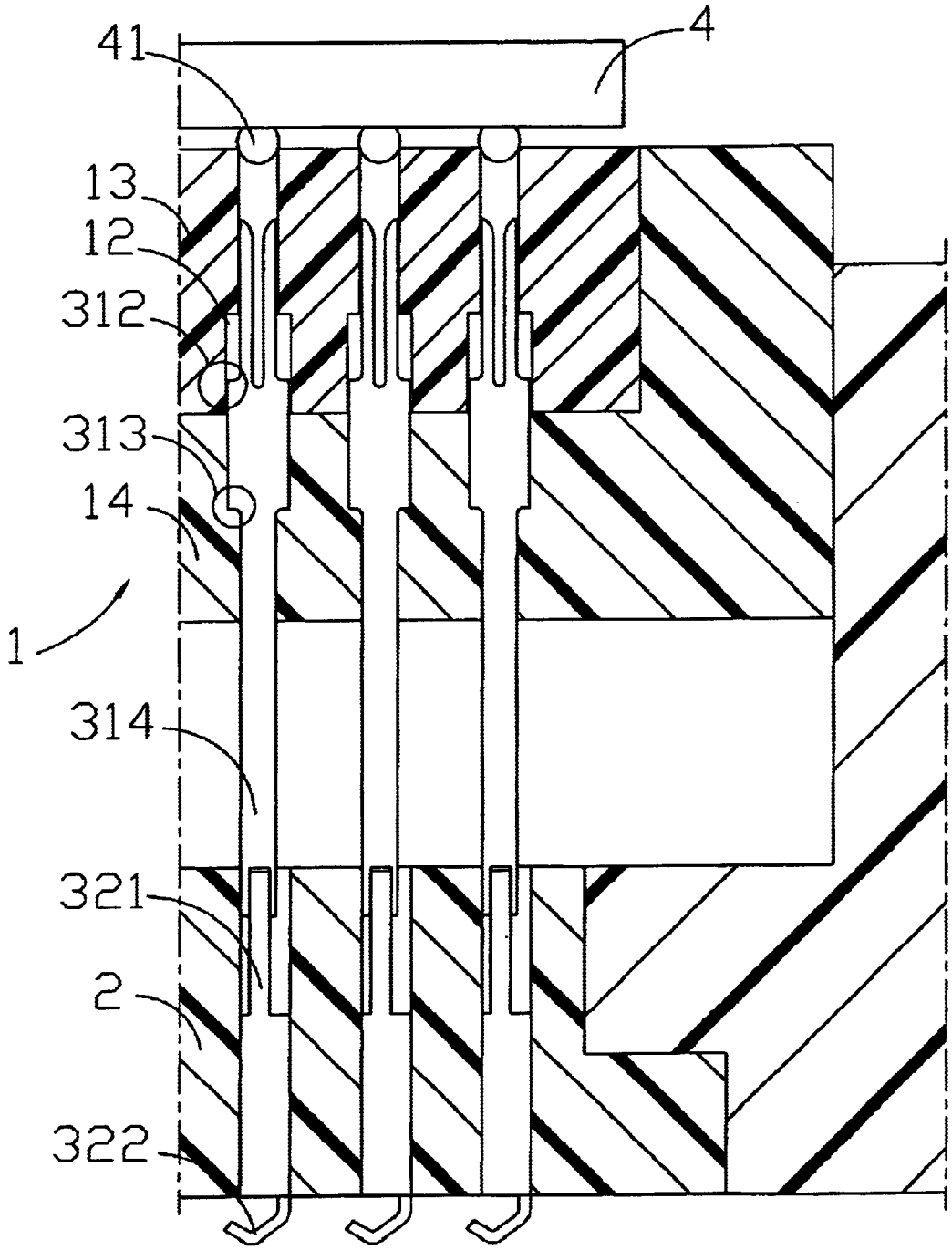
FIG. 4 is a sectional view of the matrix connector according to the first embodiment of the present invention.
Figure 5:
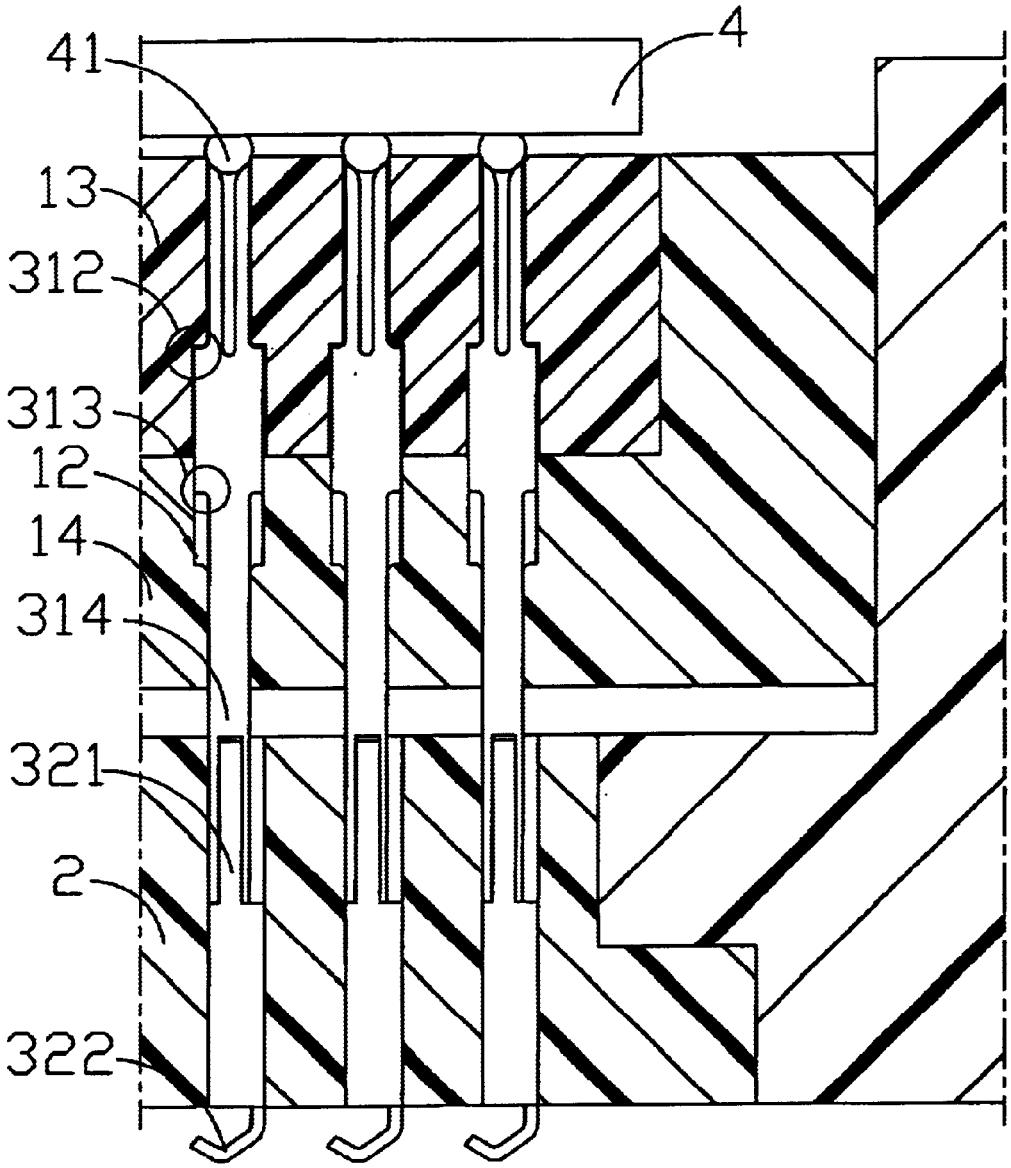
FIG. 5 is a similar to FIG. 4 but showing the front contact portions of the movable terminals of the terminal sets respectively disposed in contact with the solder balls of the IC.

Referring to FIGS. 1~3, a matrix connector in accordance with the first embodiment of the present invention is shown comprised of a first electrically insulative housing 1, a second electrically insulative housing 2, and a plurality of terminal sets 3.

The first electrically insulative housing 1 defines therein a plurality of terminal slots 11. The second electrically insulative housing 2 defines therein a plurality of terminal slots 21 corresponding to the terminal slots 11 of the first electrically insulative housing 1.

The terminal sets 3 each comprise a movable terminal 31 and a terminal holder 32. The movable terminal 31 is suspended in one terminal slot 11 of the first electrically insulative housing 1, having an axially forwardly extended front contact portion 311, which is extended to the top end of the corresponding terminal slot 11 and electrically connectable to one solder ball 41 of an IC 4 above the first electrically insulative housing 1. The terminal holder 32 is mounted in the corresponding terminal slot 21 in the second electrically insulative housing 2, having two front clamping arms 321 and a rear extension portion 322 respectively extended from the two distal ends. The front clamping arms 321 are snapped at the corresponding movable terminal 31, keeping the corresponding movable terminal 31 slidably and electrically connected to the corresponding terminal holder 32. The rear extension portion 322 is resilient and connectable to a corresponding contact at a circuit board 5.

Referring to FIGS. 4 and 5 and FIGS. 2~3 again, the movable terminal 31 of each terminal set 3 is axially slidably electrically connected to the front clamping arms 321 of the corresponding terminal holder 32. If the outer diameter of the solder ball 41 of the IC 4 above the first electrically insulative housing 1 is relatively smaller, the corresponding movable terminal 31 will be pushed by the solder ball 41 of the IC 4 to move downwards at a relatively shorter distance. Therefore, the movable terminal 31 is made having a downwardly extended endpiece 314 set in contact between the front clamping arms 321 of the corresponding terminal holder 32. During vertical displacement of the movable terminal 31, the front clamping arms 321 of the corresponding terminal holder 32 are wiping the contact surface of the endpiece 314 of the movable terminal 31, for removing dust and oxidized substance on the contact surface of the movable terminal 31 and terminal holder 32. When a downward pressure is given to the first electrically insulative housing 1 through the IC 4, the front contact portion 311 of the movable terminal 31 will be forced downwards by the corresponding solder ball 41.

The movable terminal 31 was suspended in the first insulative housing 1 by the respective terminal holder 32, having friction at the electrically contact surfaces. It is easy to modify this invention to a terminal holder having only one front clamping arm 321 at the corresponding terminal holder 32, which suspends the movable terminal 31.

Figure 6:
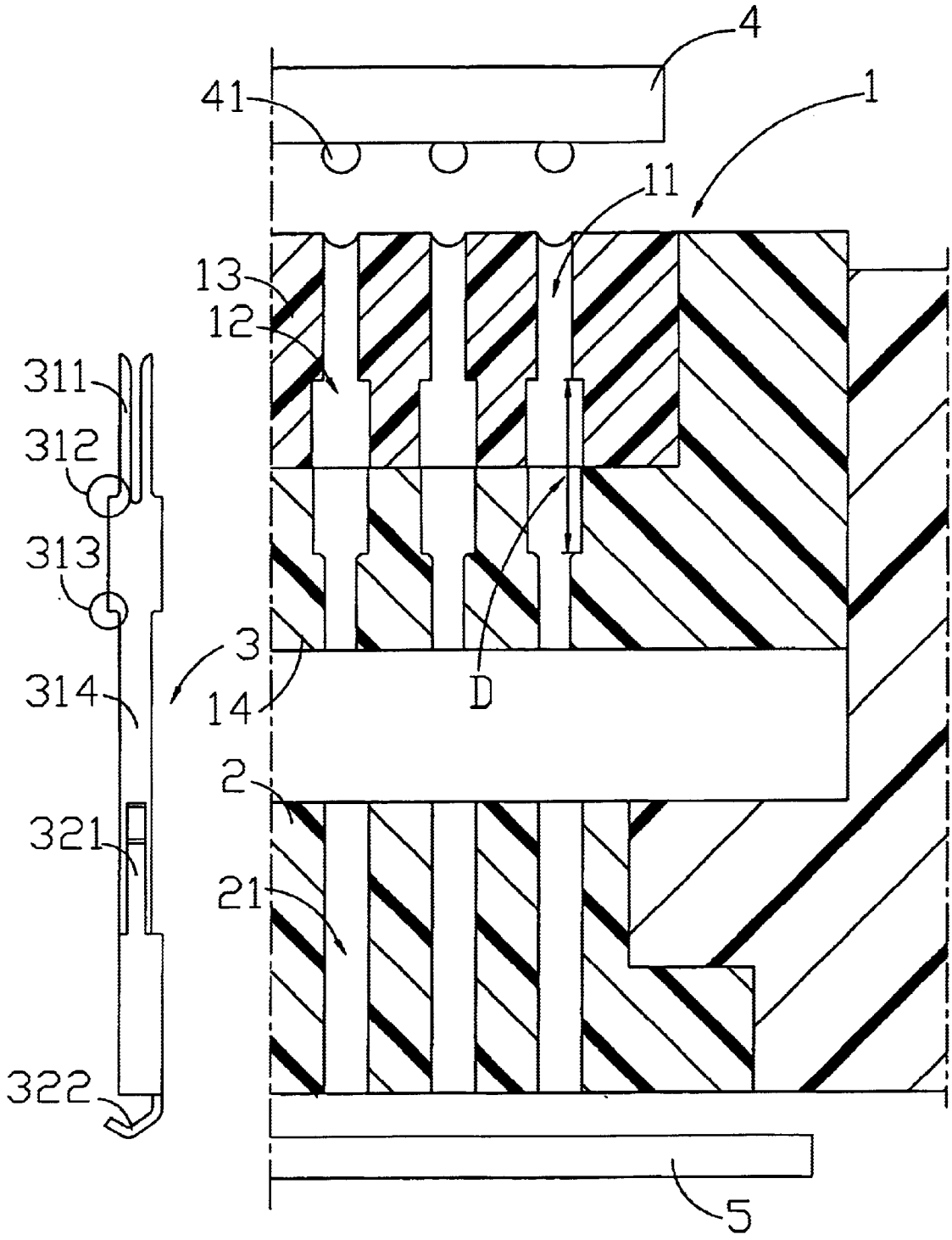
FIG. 6 is an exploded view in section of a part of the matrix connector according to the first embodiment of the present invention.

Referring to FIG. 6, the first electrically insulative housing 1 has a control space 12 respectively formed in each terminal slot 11. The size (transverse width) of the control space 12 is greater than the width of the terminal slot 11. The movable terminal 31 of each terminal set 3 has a shoulder 312 and an elbow 313 suspended in the control space 12 in the respective terminal slot 11. The distance d between the shoulder 312 and the elbow 313 is smaller than the length D of the control space 12. For easy formation of the control space 12 in each terminal slot 11, the first electrically insulative housing 1 is formed of a first insulative member 13 and a second insulative member 14, and the control space 12 has one part formed in the bottom of the first insulative member 13 and the other part formed in the top of the second insulative member 14. Therefore, the control space 12 is wholly in presence after assembly of the first insulative member 13 and the second insulative member 14.

According to the matrix connector of the present invention, it is not necessary to solder the two ends of each terminal set, i.e., the front contact portion 311 of the movable terminal 31 and the rear extension portion 322 of the terminal holder 32 to the respective contacts at the circuit board 5. However, if desired, the two ends of each terminal set can be soldered to the corresponding contacts at the circuit board 5.

Figure 7:
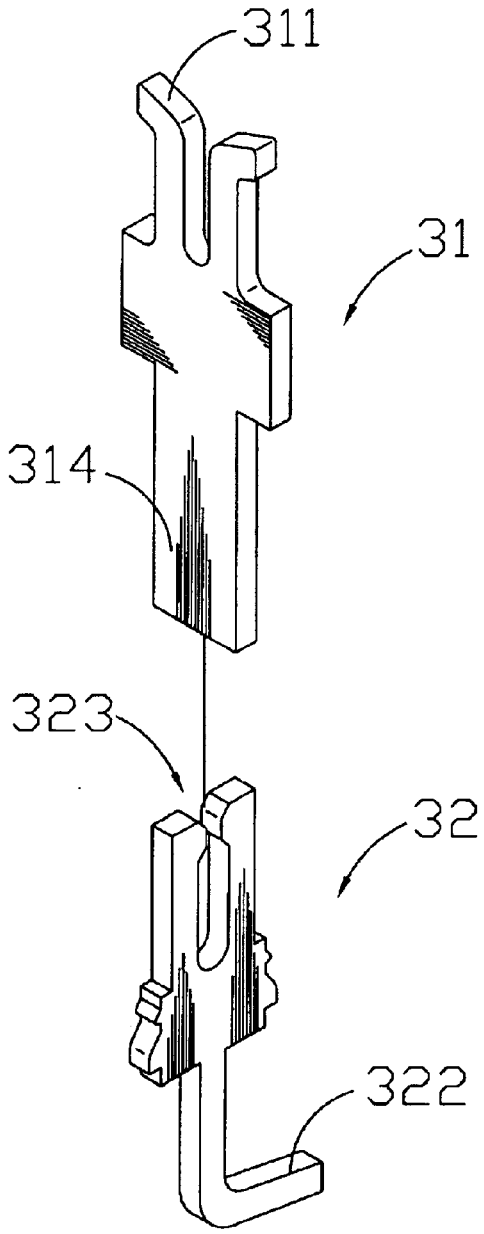
FIG. 7 is an exploded view of one terminal set for a matrix connector according to the second embodiment of the present invention.
Figure 8:
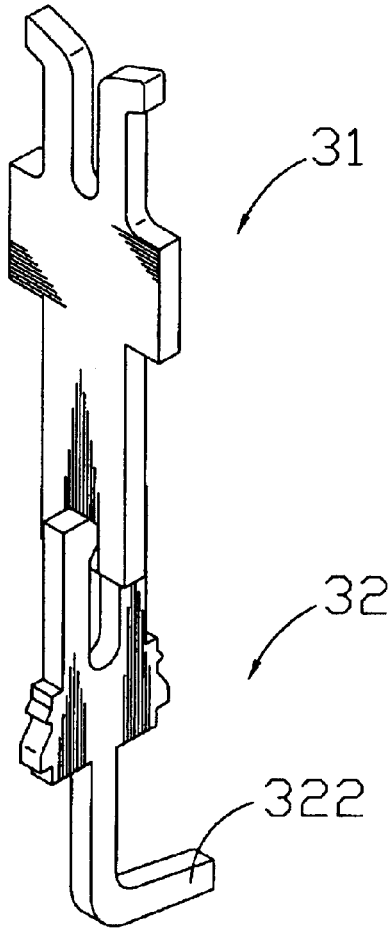
FIG. 8 is an assembly view of the terminal set shown in FIG. 7.

FIGS. 7 and 8 show an alternate form of the terminal set 3. According to this alternate form (i.e., the second embodiment of the present invention), the terminal holder 32 comprises two front clamping arms 321 defined therebetween a longitudinally forwardly extended guiding crevice 323 adapted to accommodate the endpiece 314 of the movable terminal 31 and to guide movement of the movable terminal 31 relative to the terminal holder 32. The shortest width of the guiding crevice 323 between the clamping arms 321 is slightly smaller than the thickness of the endpiece 314 of the movable terminal 31, ensuring positively electrical contact between the endpiece 314 of the movable terminal 31 and the clamping arms 321 of the terminal holder 32.

Figure 9:
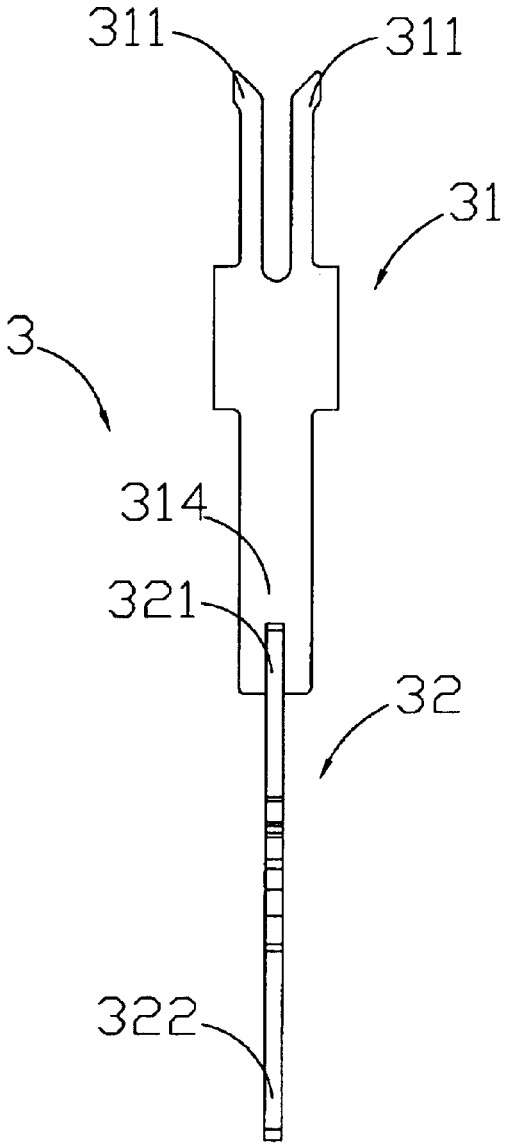
FIG. 9 is a front view of one terminal set for a matrix connector according to the third embodiment of the present invention.
Figure 10:
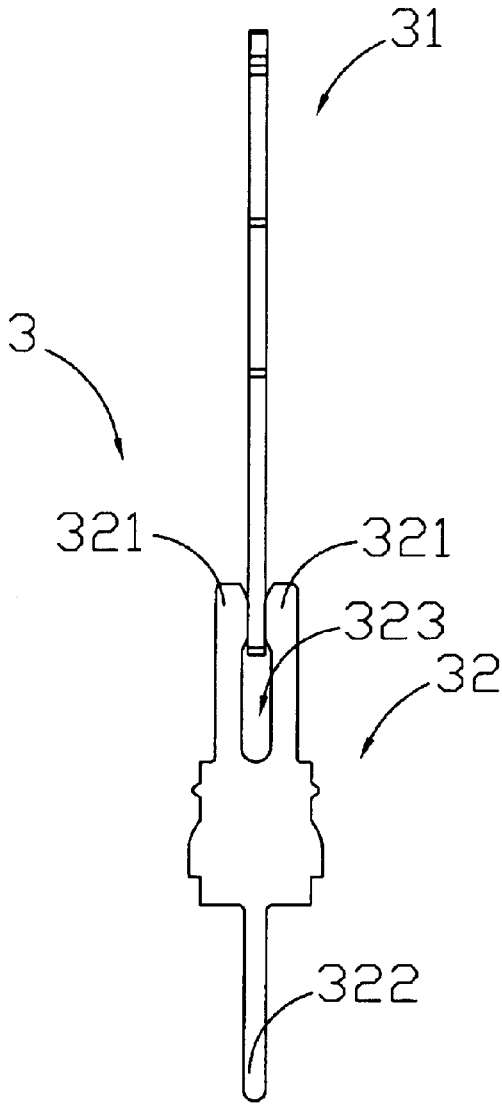
FIG. 10 is a right side view of the terminal set shown in FIG. 9.

FIGS. 9 and 10 show another alternate form of the terminal set 3. According to this embodiment (i.e., the third embodiment of the present invention), the rear extension portion 322 of the terminal holder 32 extends directly downwards for insertion through the circuit board 5, i.e., the terminal holder 32 forms a DIP terminal convenient for fixation to the circuit board 5.

Figure 11:
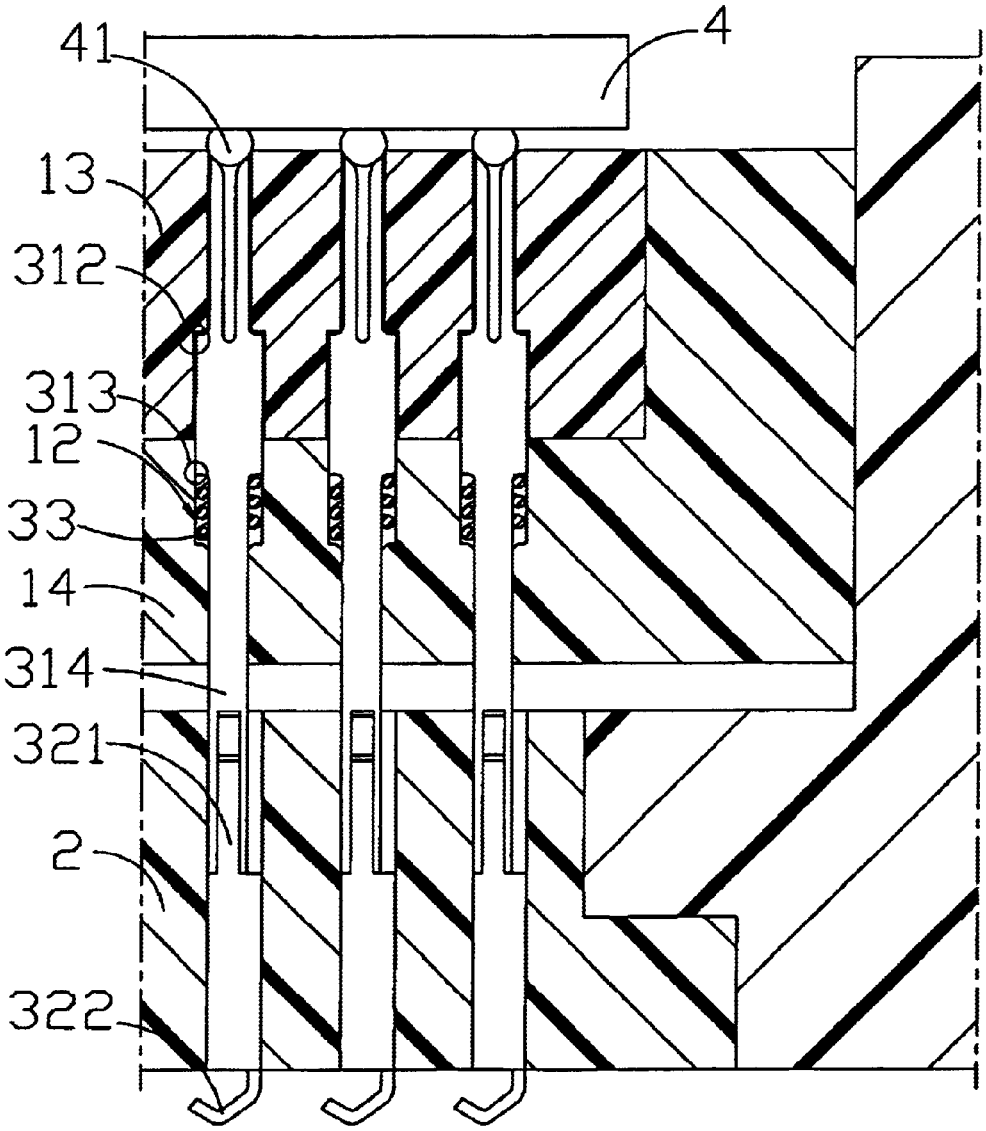
FIG. 11 is a schematic sectional view of a part of a matrix connector according to the fourth embodiment of the present invention.

FIG. 11 is a sectional view of still another alternate form of the present invention (the fourth embodiment of the present invention). According to this embodiment, a spring member 33 is sleeved onto the endpiece 314 of the movable terminal 31 of each terminal set 3 and set in the corresponding control space 12 inside the first electrically insulative housing 1 (FIG. 11 shows the spring member 33 stopped at the bottom side of the elbow 313 of the movable terminal 31 of the respective terminal set 3). During the travel of displacement of the solder ball 41 of the IC 4, the effect of the spring power of the spring member 33 keeps the front contact portion 311 of the movable terminal 31 constantly electrical contact with the solder ball 41, thereby holding the movable terminal 31 in about the upper dead point (FIG. 11 shows the shoulder 312 of the movable terminal 31 stopped against the top edge of the control space 12), ensuring positively electrical contact between the front contact portion 311 of the movable terminal 31 and the solder ball 41.

Figure 12:
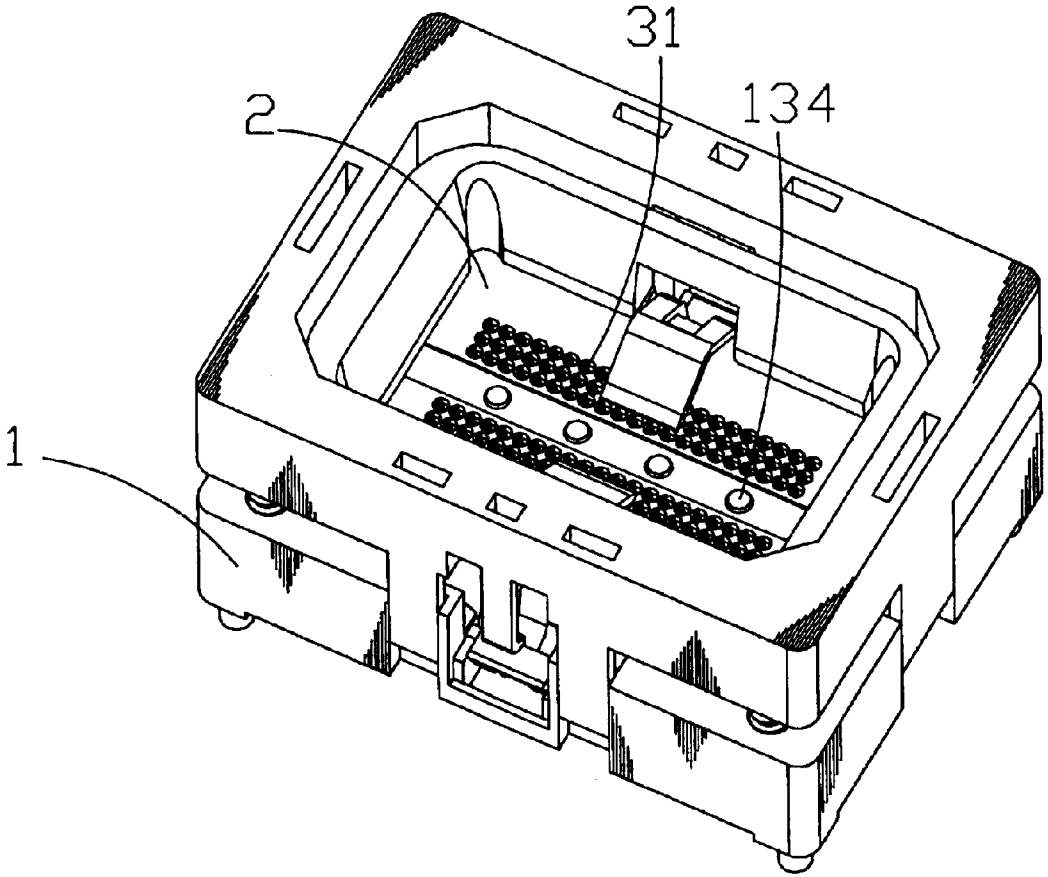
FIG. 12 is an elevational view of a matrix connector according to the fifth embodiment of the present invention.
Figure 13:
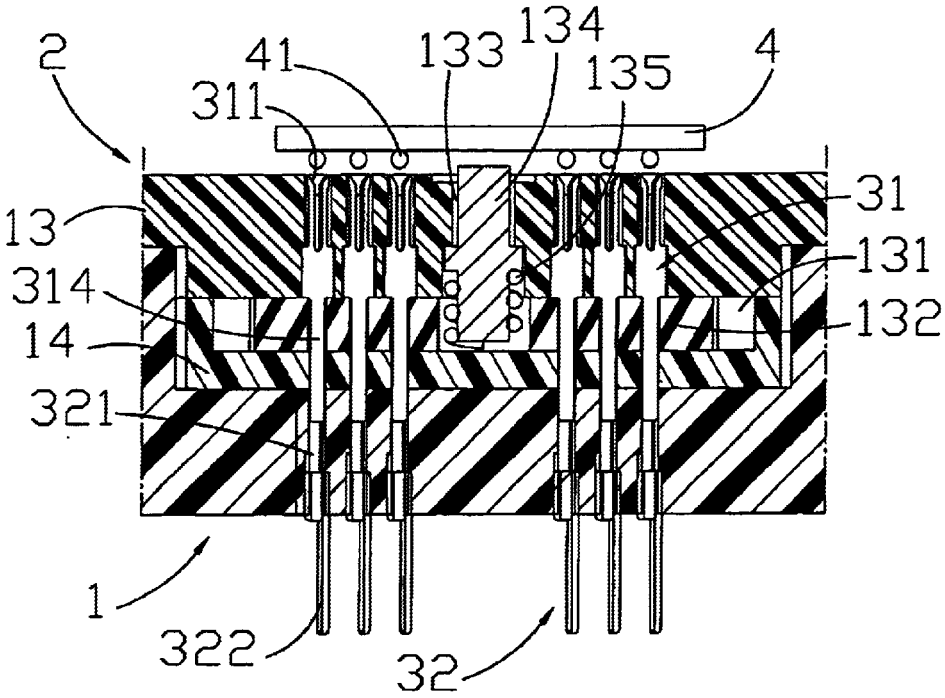
FIG. 13 is a sectional view of the matrix connector according to the fifth embodiment of the present invention.
Figure 14:
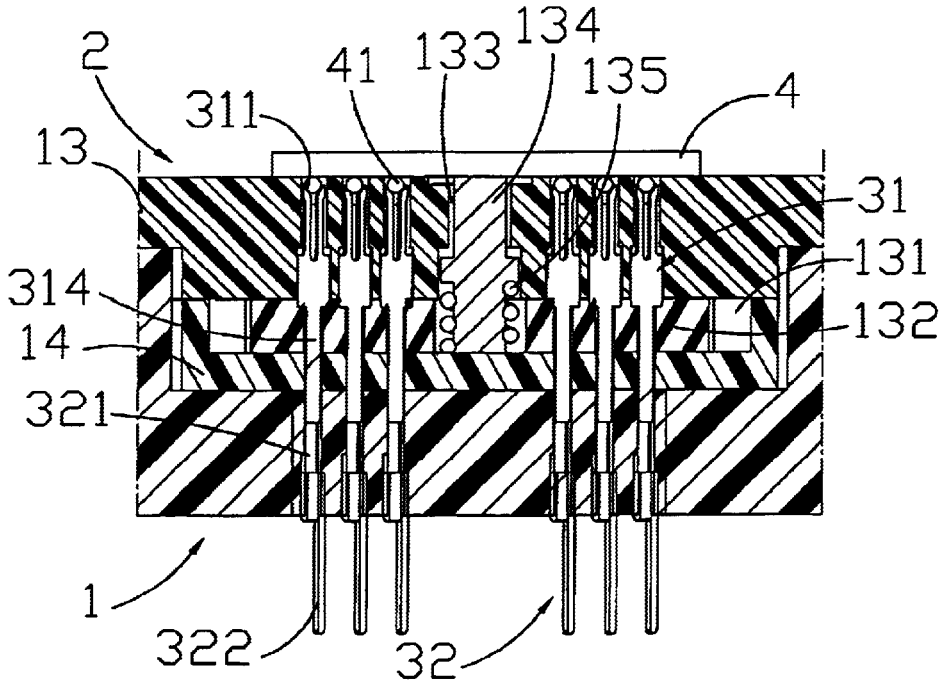
FIG. 14 is similar to FIG. 13 but showing the solder balls of the IC respectively forced into the terminal slots of the first electrically insulative housing and the springy return block compressed.

FIGS. 12~14 show still another alternate form of the present invention (the fifth embodiment of the present invention) and this embodiment is designed to an IC test socket. According to this alternate form, the relative position between the first electrically insulative housing 1 and the second electrically insulative housing 2 is constant. The first insulative member 13 of the first electrically insulative housing 1 and the second insulative member 14 define therebetween a receiving chamber 131, therebetween. A springy block 132 is mounted in said receiving chamber 131 and the springy block 132 may be molded from rubber.

When applying a downward pressure to the first electrically insulative housing 1 through the IC 4 to force each solder ball 41 against the front contact portion 311 of the movable terminal 31, the elbow 313 of the respective movable terminal 31 will compress the springy block 132, and the IC 4 will force the movable rod 134 moves downwardly in the opening 133 of the first electrically insulative housing 13 to compress the spring member 135, which supports the movable rod 134. When the downward pressure disappeared, the springy return block 132 and the spring member 135 immediately return to their former shape to push the IC 4 upwardly away from the front contact portions 311 of the terminal sets 3. The terminal slots 11 of the first electrically insulative housing 1 have a cross section greater than the diameters of the solder balls 41 of the IC 4 so that the solder balls 41 of the IC 4 can be moved in and out of the terminal slots 11 of the first electrically insulative housing 1.

In the aforesaid embodiments of the present invention, the number of the terminal sets is equal to the number of the terminal slots in the first electrically insulative housing and the number of the terminal slots in the second electrically insulative housing. However, the invention can also be employed to make a matrix connector in which the number of the terminal sets is smaller than the number of the terminal slots in the first electrically insulative housing and the number of the terminal slots in the second electrically insulative housing.

As indicated above, a matrix connector constructed according to the present invention has the following features:

1. The movable terminal 31 and terminal holder 32 of each terminal set 3 are respectively mounted in the first electrically insulative housing 1 and the second electrically insulative housing 2, and the movable terminal 31 of each terminal set 3 and the respective terminal holder 32 are relatively slidably maintained in electrically contact with each other to effectively reduce contact stress between the terminal sets 3 and the IC 4 or circuit board 5, since the movable terminal 31 is suspended by the friction between the electrical contact surfaces with the respective terminal holder 32. Therefore, this invention prevents deformation of the solder balls 41 of the IC 4 or removal of the solder balls 41 from the IC 4 during application.

2. The front clamping arms 321 of the terminal holder 32 of each terminal set 3 wipes the surface of the respective movable terminal 31 during displacement of the respective movable terminal 31 relative to the respective terminal holder 32, preventing adhering of dust or oxidized substance to the surface of the movable terminal 31 and achieving good conductivity.

3. Because the movable terminal 31 of each terminal set 3 is axially slidable relative to the respective terminal holder 32 and electrically contact with the solder ball of the IC respectively, uneven surface condition of the IC 4 or circuit board 5 does not cause electrically disconnected.

A prototype of matrix connector has been constructed with the features of FIGS. 1~14. The matrix connector functions smoothly to provide all of the features discussed earlier.

Although particular embodiments of the invention have been described in detail for purposes of illustration, various modifications and enhancements may be made without departing from the spirit and scope of the invention, for example, the toy body can be provided with a plurality of swinging mechanisms disposed at different elevations. Accordingly, the invention is not to be limited except as by the appended claims.

What the invention claimed are:

1. A matrix connector having:

a first electrically insulative housing, said first electrically insulative housing comprising a plurality of terminal slots;

a second electrically insulative housing connected to said first electrically insulative housing in a stack, said second electrically insulative housing comprising a plurality of terminal slots respectively axially set in communication with the terminal slots of said first electrically insulative housing; and a plurality of terminal sets mounted in the terminal slots of said first electrically insulative housing and said second electrically insulative housing, said terminal sets each comprising a terminal holder mounted in one terminal slot of said second electrically insulative housing and a movable terminal mounted in one terminal slot of said first electrically insulative housing, said movable terminal having a front contact portion suspended in a front end of a respective terminal slot of said first electrically insulative housing remote from said second electrically insulative housing and adapted for connecting to a respective solder ball of an integrated circuit, said terminal holder comprising two front clamping arms, which clamp on said movable terminal in such a manner that said movable terminal is maintained electrically connected to said terminal holder and axially slidable relative to said terminal holder, and a rear extension portion extended out of a respective terminal slot of said second electrically insulative housing and adapted for connecting to a circuit board.

2. The matrix connector as claimed in claim 1, wherein said first electrically insulative housing has a control space in each of the terminal slots thereof, said control space having a width greater than a diameter of a respective terminal slot; the movable terminal of each said terminal set has a shoulder and an elbow disposed at different elevations and suspended in the control space in the respective terminal slot, said shoulder and said elbow being vertically spaced from each other at a distance smaller than a vertical length of the control space in the respective terminal slot.

3. The matrix connector as claimed in claim 2, wherein said first electrically insulative housing is comprised of two insulative members vertically connected together.

4. The matrix connector as claimed in claim 2, wherein the movable terminal of each said terminal set comprises an endpiece downwardly extended from a respective elbow and coupled to the front clamping arms of the respective terminal holder.

5. The matrix connector as claimed in claim 2, wherein said movable terminal comprises an endpiece axially slidably inserted into a guide crevice of a respective terminal holder and maintained in contact with the front clamping arms of the respective terminal holder.

6. The matrix connector as claimed in claim 2, wherein the terminal slots of said first electrically insulative housing each have a front end, which has a diameter greater than a diameter of the solder balls of the integrated circuit to which the front contact portions of the movable terminals of said terminal sets are to be connected.

7. The matrix connector as claimed in claim 2, wherein said terminal sets each further comprise a spring member respectively mounted in the control space in each terminal slot of said first electrically insulative housing and adapted to support a respective movable terminal and to impart an upward pressure to the respective movable terminal.

8. The matrix connector as claimed in claim 7, wherein the spring member of each said terminal set is a compression spring.

9. The matrix connector as claimed in claim 1, wherein the rear extension portion of the terminal holder of each said terminal set is springy.

10. The matrix connector as claimed in claim 1, wherein the two front clamping arms of the terminal holder of each said terminal set defines therebetween a guide crevice adapted to receive a respective movable terminal, said guide crevice having a transverse width smaller than a thickness of the respective movable terminal.

11. The matrix connector as claimed in claim 10, wherein said movable terminal comprises an endpiece axially slidably inserted into the guide crevice of a respective terminal holder and maintained in contact with the front clamping arms of the respective terminal holder.

12. A matrix connector comprising:

a first electrically insulative housing, said first electrically insulative housing comprising a plurality of terminal slots;

comprising a first and second insulating member and a second electrically insulative housing connected to said first electrically insulative housing in a stack, said second electrically insulative housing comprising a plurality of terminal slots respectively axially set in communication with the terminal slots of said first electrically insulative housing, and a bottom receiving chamber;

a springy return block mounted in the bottom receiving chamber on said second electrically insulative housing; and a plurality of terminal sets mounted in the terminal slots of said first electrically insulative housing and said second electrically insulative housing, said terminal sets each comprising a terminal holder mounted in one terminal slot of said second electrically insulative housing and a movable terminal mounted in one terminal slot of said first electrically insulative housing, said movable terminal having a front contact portion suspended in a front end of a respective terminal slot of said first electrically insulative housing remote from said second electrically insulative housing and adapted for connecting to a respective solder ball of an integrated circuit, said terminal holder comprising two front clamping arms, which are clamped on said movable terminal in such a manner that said movable terminal is maintained electrically connected to said terminal holder and axially slidable relative to said terminal holder, and a rear extension portion extended out of a respective terminal slot of said second electrically insulative housing and adapted for connecting to a circuit board.

13. The matrix connector as claimed in claim 12, wherein said springy return block is a rubber block.

14. The matrix connector as claimed in claim 12, wherein the terminal slots of said first electrically insulative housing each have a front end, which has a diameter greater than a diameter of the solder balls of the integrated circuit to which the front contact portions of the movable terminals of said terminal sets are to be connected.

* * * * *